US010385283B2

(12) United States Patent
Arora et al.

(10) Patent No.: US 10,385,283 B2
(45) Date of Patent: Aug. 20, 2019

(54) HYDROPROCESSING THERMALLY CRACKED PRODUCTS

(71) Applicant: Lummus Technology Inc., Bloomfield, NJ (US)

(72) Inventors: Arun Arora, Edison, NJ (US); Ujjal K. Mukherjee, Montclair, NJ (US); Wai Seung Louie, Bloomfield, NJ (US); Marvin I. Greene, Clifton, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 147 days.

(21) Appl. No.: 15/460,786

(22) Filed: Mar. 16, 2017

(65) Prior Publication Data

US 2017/0183573 A1 Jun. 29, 2017

Related U.S. Application Data

(62) Division of application No. 14/180,623, filed on Feb. 14, 2014, now Pat. No. 9,631,150.
(Continued)

(51) Int. Cl.
*C10G 65/00* (2006.01)
*C10G 65/10* (2006.01)
(Continued)

(52) U.S. Cl.
CPC ..... *C10G 65/10* (2013.01); *C10G 65/00* (2013.01); *C10G 65/12* (2013.01); *C10G 65/18* (2013.01);
(Continued)

(58) Field of Classification Search
CPC ..... C10G 65/10; C10G 65/18; C10G 65/00; C10G 65/12; C10G 2300/1059;
(Continued)

(56) References Cited

U.S. PATENT DOCUMENTS 6,569,313 B1 * 5/2003 Carroll ..... C10G 65/12 208/108
2011/0079541 A1 * 4/2011 Koseoglu ..... C10G 45/08 208/59

FOREIGN PATENT DOCUMENTS

RU 1772134 C 10/1992

OTHER PUBLICATIONS

Third Office Action dated Apr. 21, 2017, by the State Intellectual Property Office of the People's Republic of China in corresponding Chinese Patent Application No. CN-201480013576.X, with USPTO Global Dossier English translation (7 pages).
(Continued)

*Primary Examiner* — Randy Boyer
*Assistant Examiner* — Juan C Valencia
(74) *Attorney, Agent, or Firm* — Osha Liang LLP

(57) ABSTRACT

Embodiments herein relate to a process flow scheme for the processing of gas oils and especially reactive gas oils produced by thermal cracking of residua using a split flow concept. The split flow concepts disclosed allow optimization of the hydrocracking reactor severities and thereby take advantage of the different reactivities of thermally cracked gas oils versus those of virgin gas oils. This results in a lower cost facility for producing base oils as well as diesel, kerosene and gasoline fuels while achieving high conversions and high catalyst lives.

12 Claims, 1 Drawing Sheet

Related U.S. Application Data

(60) Provisional application No. 61/794,859, filed on Mar. 15, 2013.

(51) Int. Cl.

| | |
|---|---|
| ***C10G 65/12*** | (2006.01) |
| ***C10G 65/18*** | (2006.01) |
| ***C10L 1/04*** | (2006.01) |
| ***C10L 1/06*** | (2006.01) |
| ***C10L 1/08*** | (2006.01) |

(52) U.S. Cl.
CPC ..... *C10L 1/04* (2013.01); *C10L 1/06* (2013.01); *C10L 1/08* (2013.01); *C10G 2300/1059* (2013.01); *C10G 2400/02* (2013.01); *C10G 2400/04* (2013.01)

(58) Field of Classification Search
CPC ... C10G 2400/04; C10G 2400/02; C10L 1/08; C10L 1/04; C10L 1/06
See application file for complete search history.

(56) References Cited

OTHER PUBLICATIONS

Office Action issued in corresponding Arab States of the Gulf Application No. GC 2014-26835 dated Apr. 30, 2017 (4 pages).
Office Action issued in Russian Application No. 2015143892; dated Mar. 20, 2017 with English Translation (14 pages).

* cited by examiner

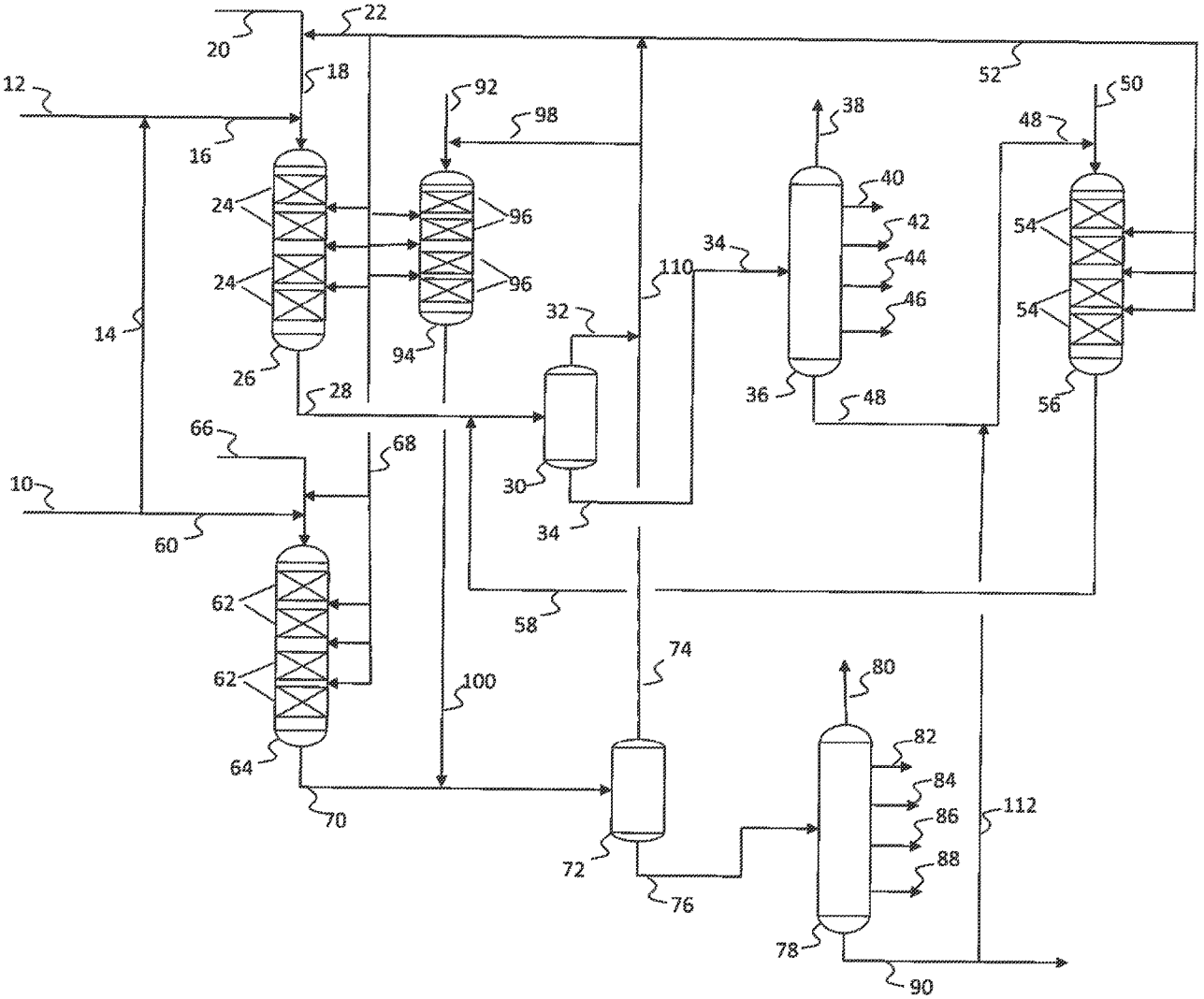
10
12
14
16
18
20
22
24
24
26
28
30
32
34
34
36
38
40
42
44
46
48
48
50
52
54
54
56
58
60
62
62
64
66
68
70
72
74
76
78
80
82
84
86
88
90
92
94
96
96
98
100
110
112

HYDROPROCESSING THERMALLY CRACKED PRODUCTS

CROSS-REFERENCE TO RELATED APPLICATIONS

This application, pursuant to 35 U.S.C. § 119(e), claims priority to U.S. Provisional Application Ser. No. 61/794,859, filed Mar. 15, 2013, and also claims benefit under 35 U.S.C. § 120 as a divisional to U.S. patent application Ser. No. 14/180,623, filed Feb. 14, 2014, which are herein incorporated by reference in its entirety.

FIELD OF THE DISCLOSURE

Embodiments disclosed herein relate generally to processing of gas oils and especially reactive gas oils produced by thermal cracking of residua using a split flow concept.

BACKGROUND

Hydrocrackers have always produced environmentally friendly products, even before environmental regulations on products increased. No other process can take low value, highly aromatic, high sulfur, and high nitrogen feedstocks and produce a full slate of desirable sweet products: LPG, high quality diesel fuel, hydrogen-rich FCC feed, ethylene cracker feed, and/or premium lube unit feedstocks.

Modern hydrocracking was commercialized in the early 1960's. These early units converted light feedstocks (from atmospheric crude towers) into high-value, high-demand gasoline products. In addition, high hydrocracker volume gain (exceeding 20%) added significantly to the refinery bottom line. Because of these strong attributes, hydrocracker capacity has increased steadily over the years.

Increased environmental regulations on gasoline and diesel have made hydrocracking the most essential process resulting in ever greater increases in worldwide capacity. The most recent grassroots hydrocrackers were designed to maximize the production of middle distillates from increasingly difficult feedstocks such as FCC LCO, Heavy Vacuum Gasoils, and Heavy Coker Gas Oils. Like their predecessors, most modem hydrocrackers produce high-value, environmentally friendly distillate products including massive volumes of ultra-low sulfur diesel (ULSD), even with progressively more demanding feedstocks Early generation hydro crackers were in the 10,000 barrel-per-day range while many new units today exceed 100,000 barrels per day.

Growing demand for middle distillates, declining market for high sulfur fuel oil, and increasingly stringent environmental regulations are putting refineries, especially those with lower Nelson Complexity Index, under immense margin pressures and even forcing many to shut down. This recent trend has led to grassroots projects for distillate-oriented conversion technologies. Very few, if any, refineries have their conversion strategy focused on FCC technology, and many FCC units are operating in low severity distillate mode or are occasionally being converted to a propylene producer. Hydrocracking offers greater flexibility to process opportunity crudes while producing premium grade clean fuels which improves refinery margins.

Some refineries have tried to solve the difficulties in dealing with heavy feedstocks by building two separate hydrocracker, one for lube and one for fuels. Another solution investigated was to just hydrotreat the thermally cracked gas oil and then feed the hydrotreated gas oil to FCC and install a high conversion hydrocracker and take a large bleed of UCO to lube base oil production. Others have proposed to solvent deasphalt the residuum feed and process only the deasphalted oil in a Resid Hydrocracking Unit (RHU), e.g., ebullated-bed hydrocracking. Also, others have processed the unconverted vacuum resid from a Resid Hydrocracking Unit in an SDA Unit and recycled the DAO back to the front end of the RHU or further treating the DAO in a residue fixed-bed hydrotreatment unit to produce low sulfur fuel oil or feed to a FCC unit.

SUMMARY OF THE DISCLOSURE

In one aspect, embodiments disclosed herein relate to a process for upgrading gas oils to distillate hydrocarbons. The process may include: dividing a first gas oil stream into a first and second portions; mixing a second gas oil stream and the first portion of the first gas oil stream to form a mixed gas oil stream; contacting the mixed gas oil stream and hydrogen with a first hydroconversion catalyst in a first hydrocracker reaction system to convert at least a portion of the hydrocarbons in the mixed gas oil stream to distillate hydrocarbons; recovering an effluent from the first hydrocracker reaction system comprising unconverted hydrocarbons and the distillate hydrocarbons; fractionating the effluent from the first hydrocracker reaction system into one or more hydrocarbon fractions including a fraction comprising the unconverted hydrocarbons; contacting hydrogen and the fraction comprising the unconverted hydrocarbons with a second hydroconversion catalyst in a second hydrocracker reaction system to convert at least a portion of the hydrocarbons in the mixed gas oil stream to distillate hydrocarbons; feeding the effluent from the second hydrocracking reaction system to the fractionating step for concurrent fractionation with the effluent from the first hydrocracker reaction system; contacting hydrogen and the second portion of the first gas oil stream with a third hydroconversion catalyst in a third hydrocracker reaction system to convert at least a portion of the hydrocarbons in the second portion to distillate hydrocarbons; fractionating an effluent from the third hydrocracker reaction system to recover two or more hydrocarbon fractions.

In another aspect, embodiments disclosed herein relate to a system for upgrading gas oils to distillate hydrocarbons. The system may include: a flow control system for dividing a first gas oil stream into a first and second portions; a mixing device for mixing a second gas oil stream and the first portion of the first gas oil stream to form a mixed gas oil stream; a first hydrocracker reaction system for contacting the mixed gas oil stream and hydrogen with a first hydroconversion catalyst to convert at least a portion of the hydrocarbons in the mixed gas oil stream to distillate hydrocarbons; a separation system for fractionating an effluent from the first hydrocracker reaction system into one or more hydrocarbon fractions including a fraction comprising the unconverted hydrocarbons; a second hydrocracker reaction system for contacting hydrogen and the fraction comprising the unconverted hydrocarbons with a second hydroconversion catalyst to convert at least a portion of the hydrocarbons in the mixed gas oil stream to distillate hydrocarbons; a flow line for feeding the effluent from the second hydrocracking reaction system to the fractionating system for concurrent fractionation with the effluent from the first hydrocracker reaction system; a third hydrocracker reaction system for contacting hydrogen and the second portion of the first gas oil stream with a third hydroconversion catalyst to convert at least a portion of the hydrocarbons in the second portion to distillate hydrocarbons; and a separation system for fractionating an effluent from the third hydrocracker reaction system to recover two or more hydrocarbon fractions.

Other aspects and advantages will be apparent from the following description and the appended claims.

BRIEF DESCRIPTION OF DRAWINGS

FIG. 1 is a simplified process flow diagram of a process for hydroprocessing gas oils according to embodiments herein.

DETAILED DESCRIPTION

In one aspect, embodiments disclosed herein relate to processing of gas oils and especially reactive gas oils produced by thermal cracking of residua using a split flow concept.

As used herein, "conversion" refers to the hydrocracking of hydrocarbon materials boiling above about 650 F to hydrocarbon materials boiling below about 650 F, both temperatures as defined by ASTM D 1160 or equivalent distillation method.

As used herein, "reaction severity" refers to the catalyst average temperature in degrees Fahrenheit of the catalysts loaded in the hydrocracking reactors of a hydrocracking reactor system multiplied by the average hydrogen partial pressure of said hydrocracking reactors in Bar absolute and divided by the liquid hourly space velocity in said hydrocracking reactors.

As used herein, "first gas oil stream" refers to gas oils derived or recovered from one or more of petroleum crudes, shale oils, tar sands bitumen, coal-derived oils, tall oils, black oils, and bio-oils and having an atmospheric equivalent, initial boiling point of about 650-680 F based on ASTM method D1160 or equivalent.

As used herein, "second gas oil stream" refers to gas oils produced from thermal or catalytic cracking of heavy oils and having an initial boiling point of about 650-680 F based on ASTM method D1160 or equivalent. In some embodiments, the second gas oil stream includes gas oils produced by at least one of delayed coking, fluid coking, visbreaking, steam cracking, and fluid catalytic cracking.

Processes for upgrading gas oils to distillate hydrocarbons according to embodiments herein may include dividing the first gas oil stream into a first and second portions. The second gas oil stream may be mixed with the first portion of the first gas oil stream to form a mixed gas oil stream or a blended gas oil stream.

The first and second gas oil streams may be mixed at a specified split gas oil ratio (defined herein as the weight ratio of second gas oil stream to that of first gas oil stream) to effect the desired hydroconversion processes and take advantage of the different reactivities of the first and second gas oil streams. In some embodiments, the second gas oil stream is blended with the first gas oil stream in a ratio of at least 0.10 kg of said second gas oil stream per kg first gas oil stream but not more than about 0.90 kg of said second gas oil stream per kg first gas oil stream. In other embodiments, the second gas oil stream is blended with the first gas oil stream in a ratio of at least 0.65 kg of said second gas oil stream per kg first gas oil stream but not more than about 0.90 kg of said second gas oil stream per kg first gas oil stream. In yet other embodiments, the second gas oil stream is blended with the first gas oil stream in a ratio of at least 0.8 kg of said second gas oil stream per kg first gas oil stream but not more than about 0.90 kg of said second gas oil stream per kg first gas oil stream.

The mixed gas oil stream and hydrogen may be contacted with a first hydroconversion catalyst in a first hydrocracker reaction system to convert at least a portion of the hydrocarbons in the mixed gas oil stream to distillate hydrocarbons. An effluent recovered from the first hydrocracker reaction system may include unconverted hydrocarbons and the distillate hydrocarbons. The effluent from the first hydrocracker reaction system may be fractionated into one or more hydrocarbon fractions including a fraction comprising the unconverted hydrocarbons.

Hydrogen and the fraction comprising the unconverted hydrocarbons may be contacted with a second hydroconversion catalyst in a second hydrocracker reaction system to convert at least a portion of the hydrocarbons in the mixed gas oil stream to distillate hydrocarbons. The effluent from the second hydrocracking reaction system may be fed to the fractionating step for concurrent fractionation with the effluent from the first hydrocracker reaction system.

Hydrogen and the second portion of the first gas oil stream may be contacted with a third hydroconversion catalyst in a third hydrocracker reaction system to convert at least a portion of the hydrocarbons in the second portion to distillate hydrocarbons. The effluent from from the third hydrocracker reaction system may then be fractionated to recover two or more hydrocarbon fractions.

Concurrent separation or fractionation of the effluent from the first and second hydrocracker reaction systems may include initially feeding the effluents from the first and second hydrocracker reaction systems to a vapor-liquid separator to recover a vapor fraction and a liquid fraction. The liquid fraction may then be fractionated in one or more distillation columns into the one or more hydrocarbon fractions including a fraction comprising the unconverted hydrocarbons. In some embodiments, the liquid fraction may be separated to recover a C4-fraction, a light naphtha fraction, a heavy naphtha fraction, a kerosene fraction, a diesel fraction, and a base oil fraction.

Separation or fractionation of the effluent from the third hydrocracker reaction system also may include initially feeding the effluent to a vapor-liquid separator to recover a vapor fraction and a liquid fraction. The liquid fraction may then be fractionated in one or more distillation columns into the one or more hydrocarbon fractions including a fraction comprising the unconverted hydrocarbons. In some embodiments, the liquid fraction may be separated to recover a C4-fraction, a light naphtha fraction, a heavy naphtha fraction, a kerosene fraction, a diesel fraction, and a base oil fraction.

In some embodiments, the effluent from the third hydrocracker reaction system may be fed to a common separation system for processing along with the first and second effluents.

In some embodiments, an effluent from a diesel hydrotreating unit may also be fed to the separation system processing the effluent from the third hydrocracker reaction system. Where a diesel hydrotreating unit effluent is co-processed, embodiments disclosed herein may include the steps of: hydrotreating a hydrocarbon feedstock in a diesel hydrotreating unit; recovering an effluent from the diesel hydrotreating unit; and feeding the effluent from the diesel hydrotreating unit to the fractionating step for concurrent fractionation with the effluent from the third hydrocracker reaction system.

The vapor fractions recovered from the vapor-liquid separators may contain unreacted hydrogen. At least a portion of the vapor fraction is recycled in some embodiments to one or more of the first hydrocracker reaction system, the second hydrocracker reaction system, the third hydrocracker reaction system, and the distillate hydrotreating system.

In some embodiments, at least a portion of the base oil fraction recovered from the effluent from the third hydrocracker reaction system may be fed to the second hydrocracker reaction system. The added process flexibility afforded by flow lines providing this option may allow the system to adjust to seasonal demands for fuels and/or base oils and lube oils as needed.

The first hydrocracking reactor system may be operated to achieve at least 30% conversion in some embodiments; at least 40% conversion in other embodiments; and at least 50% conversion in yet other embodiments.

The second hydrocracking reactor system may be operated to achieve at least 45% conversion in some embodiments; at least 55% conversion in other embodiments; and at least 70% conversion in yet other embodiments.

The third hydrocracking reactor system may be operated to achieve at least 50% conversion in some embodiments; at least 60% conversion in other embodiments; and at least 70% conversion in yet other embodiments.

The reaction severity for the first hydrocracking reaction system may be at least about 35,000° F.-Bara-Hr but no more than about 225,000° F.-Bara-Hr. The reaction severity for the second hydrocracking reaction system may be at least about 25,000° F.-Bara-Hr but no more than about 110,000° F.-Bara-Hr. The reaction severity for the third hydrocracking reaction system may be at least about 50,000° F.-Bara-Hr but no more than about 235,000° F.-Bara-Hr.

Embodiments disclosed herein also relate to a system for upgrading gas oils to distillate hydrocarbons. The system may include a flow control system for dividing a first gas oil stream into a first and second portions. A mixing device may then be used for mixing a second gas oil stream and the first portion of the first gas oil stream to form a mixed gas oil stream. Mixing devices useful in embodiments herein may include mixing tees, agitated vessels, pumps, pump around loops, and other mixing devices known to those in the art.

A first hydrocracker reaction system may then be used for contacting the mixed gas oil stream and hydrogen with a first hydroconversion catalyst to convert at least a portion of the hydrocarbons in the mixed gas oil stream to distillate hydrocarbons. A separation system is used for fractionating an effluent from the first hydrocracker reaction system into one or more hydrocarbon fractions including a fraction comprising the unconverted hydrocarbons.

A second hydrocracker reaction system may be used for contacting hydrogen and the fraction comprising the unconverted hydrocarbons with a second hydroconversion catalyst to convert at least a portion of the hydrocarbons in the mixed gas oil stream to distillate hydrocarbons. The system may also include a flow line for feeding the effluent from the second hydrocracking reaction system to the fractionating system for concurrent fractionation with the effluent from the first hydrocracker reaction system;

A third hydrocracker reaction system may be used for contacting hydrogen and the second portion of the first gas oil stream with a third hydroconversion catalyst to convert at least a portion of the hydrocarbons in the second portion to distillate hydrocarbons. The effluent from the third hydrocracker reaction system may then be forwarded to a separation system for fractionating an effluent from the third hydrocracker reaction system to recover two or more hydrocarbon fractions.

Systems according to embodiments herein may also include at least one of a delayed coking system, a fluid coking system, a visbreaking system, a steam cracking system, and a fluid catalytic cracking system for producing the second gas oil stream.

The flow control system is configured in some embodiments to blend the second gas oil stream with the first gas oil stream in a ratio of at least 0.10 kg of said second gas oil stream per kg first gas oil stream but not more than about 0.90 kg of said second gas oil stream per kg first gas oil stream. In other embodiments, the flow control system is configured to blend the second gas oil stream with the first gas oil stream in a ratio of at least 0.65 kg of said second gas oil stream per kg first gas oil stream but not more than about 0.90 kg of said second gas oil stream per kg first gas oil stream. In yet other embodiments, the flow control system is configured to blend the second gas oil stream with the first gas oil stream at a ratio of at least 0.8 kg of said second gas oil stream per kg first gas oil stream but not more than about 0.90 kg of said second gas oil stream per kg first gas oil stream.

The separation system for fractionating the effluent from the first and second hydrocracker reaction systems may include: a vapor-liquid separator for separating the first and second hydrocracker reaction systems into a vapor fraction and a liquid fraction, and a fractionation system for fractionating the liquid fraction into the one or more hydrocarbon fractions including a fraction comprising the unconverted hydrocarbons. One or more flow lines may be used to recycle at least a portion of the vapor fraction to one or more of the first hydrocracker reaction system, the second hydrocracker reaction system, the third hydrocracker reaction system, and a distillate hydrotreating system.

In some embodiments, the separation system for fractionating the effluent from the third hydrocracker reaction system is a common separation system with that for separating the effluents from the first and second hydrocracker reaction systems.

The systems for processing gas oils according to embodiments herein may also include a diesel hydrotreating unit for hydrotreating a hydrocarbon feedstock and a flow conduit for feeding the effluent from the diesel hydrotreating unit to the separation system for fractionating step for concurrent fractionation with the effluent from the third hydrocracker reaction system.

The separation system for fractionating the effluent from the third hydrocracker reaction system may be configured to fractionate the effluent into a C4-fraction, a light naphtha fraction, a heavy naphtha fraction, a kerosene fraction, a diesel fraction, and a base oil fraction. A flow conduit may be provided for feeding at least a portion of the base oil fraction to the second hydrocracker reaction system.

The system may include an operating system configured to: operate the first hydrocracking reactor system to achieve at least 30% conversion and more preferably at least 40% conversion and most preferably at least 50% conversion; operate the second hydrocracking reactor system to achieve at least 45% conversion and more preferably at least 55% conversion and most preferably at least 70% conversion; and operate the third hydrocracking reactor system to achieve at least 50% conversion and more preferably at least 60% conversion and most preferably at least 70% conversion. The operating system may also be configure to control: the reaction severity for the first hydrocracking reaction system in the range from about 35,000° F.-Bara-Hr to less than about 225,000° F.-Bara-Hr, the reaction severity for the second hydrocracking reaction system in the range from about 25,000° F.-Bara-Hr to less than about 110,000° F.-Bara-Hr, and the reaction severity for the third hydrocracking reaction system in the range from about 50,000° F.-Bara-Hr to less than about 235,000° F.-Bara-Hr.

Referring now to FIG. 1, a simplified process flow diagram of processes for upgrading gas oils according to embodiments herein is illustrated. A first gas oil stream 10 and a second gas oil stream 12 are fed to the system. A portion 14 of the first gas oil stream 10 may be mixed with the second gas oil stream 14 at a specified split gas oil ratio to form a mixed gas oil stream 16.

The mixed gas oil stream 16 and hydrogen 18 (which may include fresh or make-up hydrogen 20 as well as recycle hydrogen 22) may be contacted with a first hydroconversion catalyst 24 in a first hydrocracker reaction system 26 to convert at least a portion of the hydrocarbons in the mixed gas oil stream to distillate hydrocarbons. Recycle or fresh hydrogen may also be fed intermediate one or more catalyst beds 24 in reaction system 26.

An effluent 28 recovered from the first hydrocracker reaction system may include unconverted hydrocarbons and the distillate hydrocarbons. The effluent 28 from the first hydrocracker reaction system 26 may then be fed to vapor-liquid separator 30 to recover a vapor fraction 32 and a liquid fraction 34. The liquid fraction may then be fed to a fractionation system 36 to fractionate the liquid fraction 34 into a C4-fraction 38, a light naphtha fraction 40, a heavy naphtha fraction 42, a kerosene fraction 44, a diesel fraction 46, and a base oil fraction 48.

Base oil fraction 48 and hydrogen (which may include fresh or make-up hydrogen 50 as well as recycle hydrogen 52) may be contacted with a second hydroconversion catalyst 54 in a second hydrocracker reaction system 56 to convert at least a portion of the hydrocarbons in the base oil stream to distillate hydrocarbons. Recycle or fresh hydrogen may also be fed intermediate one or more catalyst beds 54 in reaction system 56.

The effluent 58 from the second hydrocracking reaction system 56 may be fed to the vapor-liquid separator 30 and frationator 36 for concurrent fractionation with the effluent 28 from the first hydrocracker reaction system 26.

The second portion 60 of the first gas oil stream 10 and hydrogen (which may include fresh or make-up hydrogen 66 as well as recycle hydrogen 68) may be contacted with a third hydroconversion catalyst 62 in a third hydrocracker reaction system 64 to convert at least a portion of the hydrocarbons in the second portion 60 to distillate hydrocarbons. Recycle or fresh hydrogen may also be fed intermediate one or more catalyst beds 62 in reaction system 64.

An effluent 70 recovered from the third hydrocracker reaction system may include unconverted hydrocarbons and distillate hydrocarbons. The effluent 70 from the third hydrocracker reaction system 64 may then be fed to vapor-liquid separator 72 to recover a vapor fraction 74 and a liquid fraction 76. The liquid fraction may then be fed to a fractionation system 78 to fractionate the liquid fraction 76 into a C4-fraction 80, a light naphtha fraction 82, a heavy naphtha fraction 84, a kerosene fraction 86, a diesel fraction 88, and a base oil fraction 90.

In some embodiments, a hydrocarbon feed 92 and hydrogen (which may include at least one of fresh or make-up hydrogen feed (not illustrated) and recycle hydrogen 98) may be provided to a diesel hydrotreating reactor 94 hydrotreatment of the hydrocarbon feed over a hydrotreatment catalyst 96. The effluent 100 from diesel hydrotreating reactor 94 may be co-processed with effluent 70 from the third hydrocracker reactor system 64 in vapor-liquid separator 72 and fractionation system 78.

Vapor fraction 74 and vapor fraction 32 may be rich in unreacted hydrogen. In some embodiments, these vapor fractions may be recycled to one or more of reactor systems 26, 64, and 56, as well as 94 when present. As illustrated in FIG. 1, vapor fractions 32, 74 may be combined to form recycle vapor fraction 110 which may then be distributed via flow lines 22, 52, 68 as required to the respective reactor feed lines and interstage feed ports.

In some embodiments, process flexibility with respect to fuel or oil production may be afforded by feeding a portion of the base oil fraction 90 via flow line 112 to second hydrocracker reaction system 56.

As described above, the process of FIG. 1 is a two stage recycle scheme that may be used to process refractory feeds such as HCGO and HVGO. The process may be used to maximize diesel with severe cold flow property specifications, along with providing the flexibility to produce feed for Group III lube base oils production.

This processing scheme may be useful, for example, with Heavy Vacuum Gas oil (HVGO) from WestSiberian and Sakhalin crudes and Heavy Coker Gas Oil (HCGO) to maximize the production of Euro-V diesel—with an option to produce feed for the Group III lubes. The system may also be integrated with a hydrotreating unit to upgrade distillates using the split-feed injection technology.

HVGO and HCGO are processed in parallel first-stage reactor systems with a shared second stage. When the unit operates in fuels mode, the unconverted oil (UCO) from the VGO section is mixed with UCO from the HCGO section and hydrocracked to extinction in the common second stage. In base oil production mode, the UCO bleed is fed to the lube oil unit.

Catalyst bed 24, 54, 62 and 96 may include the same or different catalysts. Catalyst beds within the individual reactors may also include a single catalyst in all beds of the reactor, mixtures of catalysts within a single bed or different catalysts in different beds. A catalyst system useful for the first stage hydrocracking reactor system reactor, processing as high as 65% HCGO, may include a primarily Ni—Mo hydrotreating catalyst followed by a high activity middle distillate selective hydrocracking catalysts.

The third stage hydrocracker reactor, processing HVGO, may be loaded with high middle distillate selective hydrocracking catalyst. The catalyst system is tailored for increasing the Viscosity Index (VI) of the UCO to a level where, after dewaxing, Group III base oils can be produced.

The second stage hydrocracker reactor system may include a high distillate selective, high hydrogenation function, second-stage catalyst.

Embodiments disclosed herein provide a novel integrated scheme for the processing of gas oils and especially reactive gas oils produced by thermal cracking of residua using a split flow concept. Table 1 compares the relative reaction severities and feed types for each of the three hydrocracking reaction systems used in processes disclosed herein.

| | First Hydrocracker Reaction System | Third Hydrocracker Reaction System | Second Hydrocracker Reaction System |
|---|---|---|---|
| Severity | Intermediate | Highest | Lowest |
| Feed | Mix of VGO and thermally cracked VGO | VGO | UCO from 1st and 3rd hydrocracker reaction systems |

Table 2 compares the operating ranges defined for each reactor stage as described above for some embodiments disclosed herein.

| | First Hydrocracker Reaction System | Third Hydrocracker Reaction System | Second Hydrocracker Reaction System |
|---|---|---|---|
| Severity Range | Intermediate | Highest | Lowest |
| Min Temp Range, ° F. | 710 | 710 | 650 |
| Max Temp Range, ° F. | 750 | 760 | 690 |
| Preferred Temp Range, ° F. | 735-745 | 730-740 | 665-685 |
| Min LHSV | 0.5 | 0.5 | 1.0 |
| Max LHSV | 1.1 | 0.9 | 1.5 |
| Preferred LHSV range | 0.6-0.8 | 0.5-0.7 | 1.0-1.4 |
| Max H2 partial pressure range, Bara | 145 | 152 | 152 |
| Min H2 partial pressure range, Bara | 105 | 115 | 105 |
| Preferred H2 partial pressure range, Bara | 138 | 138 | 138 |
| Min % Conversion | 40 | 60 | 45 |
| Max % Conversion | 50 | 75 | 75 |
| Preferred % Conversion Range | 40-50 | 60-70 | 55-70 |

For the ranges of conditions shown in the Table 2, the range of maximum and minimum reactor severities is defined as shown in Table 3.

| Reactor Severity, ° F.-Bara-Hr | | | | | |
|---|---|---|---|---|---|
| First Hydrocracker Reaction System | | Third Hydrocracker Reaction System | | Second Hydrocracker Reaction System | |
| Min | Max | Min | Max | Min | Max |
| 36260 | 220140 | 51000 | 236700 | 24000 | 110000 |

As described above, embodiments disclosed herein provide for a split flow scheme for processing of gas oils. The split flow concept may allow optimization of the hydrocracking reactor severities and thereby take advantage of the different reactivities of thermally cracked gas oils versus those of virgin gas oils. This results in a lower cost facility for producing base oils as well as diesel, kerosene and gasoline fuels while achieving high conversions and high catalyst lives.

Advantageously, embodiments disclosed herein may effectively integrates fixed-bed residue hydrotreatment with Resid Hydrocracking. Embodiments disclosed herein may also avoid building two separate hydrocrackers, one for lube base oil product and one for transportation fuel product. Lower investment cost (common recycle compressor, make-up compressor, and other high pressure loop equipment) may also be realized.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A system for upgrading gas oils to distillate hydrocarbons, the system comprising:

a mixing device for mixing a first portion of a first gas oil stream with a second gas oil stream to form a mixed gas oil stream;

a first hydrocracker reaction system for contacting the mixed gas oil stream and hydrogen with a first hydroconversion catalyst to convert at least a portion of the hydrocarbons in the mixed gas oil stream to distillate hydrocarbons;

a separation system for fractionating an effluent from the first hydrocracker reaction system into one or more hydrocarbon fractions including a fraction comprising the unconverted hydrocarbons;

a second hydrocracker reaction system for contacting hydrogen and the fraction comprising the unconverted hydrocarbons with a second hydroconversion catalyst to convert at least a portion of the hydrocarbons in the mixed gas oil stream to distillate hydrocarbons;

a flow line for feeding the effluent from the second hydrocracking reaction system to the fractionating system for concurrent fractionation with the effluent from the first hydrocracker reaction system;

a third hydrocracker reaction system for contacting hydrogen and a second portion of the first gas oil stream with a third hydroconversion catalyst to convert at least a portion of the hydrocarbons in the second portion to distillate hydrocarbons;

a separation system for fractionating an effluent from the third hydrocracker reaction system to recover two or more hydrocarbon fractions;

a diesel hydrotreating unit for hydrotreating a hydrocarbon feedstock;

a flow conduit for feeding the effluent from the diesel hydrotreating unit to the separation system for fractionating step for concurrent fractionation with the effluent from the third hydrocracker reaction system.

2. The system of claim 1, further comprising at least one of a delayed coking system, a fluid coking system, a visbreaking system, a steam cracking system, and a fluid catalytic cracking system for producing the second gas oil stream.

3. The system of claim 1, wherein a flow control system is configured to blend the second gas oil stream with the first portion of the first gas oil stream in a ratio of at least 0.10 kg of said second gas oil stream per kg of the first portion of the first gas oil stream but not more than about 0.90 kg of said second gas oil stream per kg of the first portion of the first gas oil stream.

4. The system of claim 1, wherein a flow control system is configured to blend the second gas oil stream with the first portion of the first gas oil stream in a ratio of at least 0.65 kg of said second gas oil stream per kg of the first portion of the first gas oil stream but not more than about 0.90 kg of said second gas oil stream per kg of the first portion of the first gas oil stream.

5. The system of claim 1, wherein a flow control system is configured to blend the second gas oil stream with the first portion of the first gas oil stream at a ratio of at least 0.8 kg of said second gas oil stream per kg of the first portion of the first gas oil stream but not more than about 0.90 kg of said second gas oil stream per kg of the first portion of the first gas oil stream.

6. The system of claim 1, wherein the separation system for fractionating the effluent from the first and second hydrocracker reaction systems comprises:

a vapor-liquid separator for separating the first and second hydrocracker reaction systems into a vapor fraction and a liquid fraction;

a fractionation system for fractionating the liquid fraction into the one or more hydrocarbon fractions including a fraction comprising the unconverted hydrocarbons.

7. The system of claim 6, further comprising one or more flow lines to recycle at least a portion of the vapor fraction to one or more of the first hydrocracker reaction system, the second hydrocracker reaction system, the third hydrocracker reaction system, and a distillate hydrotreating system.

8. The system of claim 1, wherein the separation system for fractionating the effluent from the third hydrocracker reaction system is the same separation system with that for separating the effluents from the first and second hydrocracker reaction systems.

9. The system of claim 1, wherein the separation system for fractionating the effluent from the third hydrocracker reaction system is configure to fractionate the effluent into a C4-fraction, a light naphtha fraction, a heavy naphtha fraction, a kerosene fraction, a diesel fraction, and a base oil fraction.

10. The system of claim 9, further comprising a flow conduit for feeding at least a portion of the base oil fraction to the second hydrocracker reaction system.

11. The system of claim 1, further comprising an operating system configured to: operate the first hydrocracking reactor system to achieve at least 30% conversion; operate the second hydrocracking reactor system to achieve at least 45% conversion; and operate the third hydrocracking reactor system to achieve at least 50% conversion, wherein conversion is defined as the hydrocracking of hydrocarbon materials boiling above about 650° F. to hydrocarbon materials boiling below about 650° F., both temperatures as defined by ASTM D 1160 or equivalent distillation method.

12. The system of claim 11, wherein the operating system is configured for controlling:

the reaction severity for the first hydrocracking reaction system in the range from about 35,000° F.-Bara-Hr to less than about 225,000° F.-Bara-Hr;

the reaction severity for the second hydrocracking reaction system in the range from about 25,000° F.-Bara-Hr to less than about 110,000° F.-Bara-Hr; and the reaction severity for the third hydrocracking reaction system in the range from about 50,000° F.-Bara-Hr to less than about 235,000° F.-Bara-Hr, wherein reaction severity is defined as the catalyst average temperature in degrees Fahrenheit of the catalysts loaded in the hydrocracking reactors of a hydrocracking reactor system multiplied by the average hydrogen partial pressure of said hydrocracking reactors in Bar absolute and divided by the liquid hourly space velocity in said hydrocracking reactors.

* * * * *